US005912220A

United States Patent [19]

Sramek et al.

[11] Patent Number: 5,912,220

[45] **Date of Patent: *Jun. 15, 1999**

[54] SURFACTANT COMPLEX WITH ASSOCIATIVE POLYMERIC THICKENER

[75] Inventors: John A. Sramek, Wind Point; Howard A. Doumaux, Mt. Pleasant; Teeradetch Tungsubutra, Mt. Pleasant; Peter J. Schroeder, Mt. Pleasant, all of Wis.

[73] Assignee: S. C. Johnson & Son, Inc., Racine, Wis.

[ * ] Notice: This patent is subject to a terminal disclaimer.

[21] Appl. No.: 08/717,453

[22] Filed: Sep. 20, 1996

[51] Int. Cl.[6] ..... C11D 3/37; C11D 1/72; D06M 15/00; D06M 15/263

[52] U.S. Cl. ..... 510/284; 510/421; 510/434; 510/435; 510/476

[58] Field of Search ..... 510/180, 181, 510/283, 284, 345, 476, 435, 434, 421

[56] References Cited

U.S. PATENT DOCUMENTS

| | | | |
|---|---|---|---|
| 3,682,849 | 8/1972 | Smith et al. . | |
| 3,759,861 | 9/1973 | Shimokawa . | |
| 3,953,353 | 4/1976 | Barrett, Jr. et al. . | |
| 4,351,754 | 9/1982 | Dupre . | |
| 4,363,756 | 12/1982 | Sepulveda et al. . | |
| 4,438,009 | 3/1984 | Brusky et al. . | |
| 4,508,635 | 4/1985 | Clarke . | |
| 4,595,527 | 6/1986 | Gipp . | |
| 4,749,516 | 6/1988 | Brusky . | |
| 4,842,762 | 6/1989 | Sabol, Jr. et al. . | |
| 4,883,610 | 11/1989 | Ciallella . | |
| 4,908,039 | 3/1990 | Holland et al. . | |
| 4,931,063 | 6/1990 | Wilsberg et al. . | |
| 5,026,400 | 6/1991 | Holland et al. . | |
| 5,205,960 | 4/1993 | Kristopeit et al. | 510/476 |
| 5,277,708 | 1/1994 | Stuart . | |
| 5,288,420 | 2/1994 | Mandy . | |
| 5,384,060 | 1/1995 | Mandy et al. . | |
| 5,393,453 | 2/1995 | Mondin et al. . | |
| 5,393,454 | 2/1995 | Mondin et al. . | |
| 5,399,285 | 3/1995 | Kanluen | 510/476 |
| 5,447,649 | 9/1995 | Gormsen . | |
| 5,489,397 | 2/1996 | Bainbridge . | |
| 5,501,813 | 3/1996 | Fischer et al. . | |
| 5,507,968 | 4/1996 | Palaikis . | |
| 5,648,326 | 7/1997 | Sramek | 510/476 |
| 5,652,208 | 7/1997 | Sramek | 510/476 |

FOREIGN PATENT DOCUMENTS

| | | |
|---|---|---|
| 2452250 | 10/1980 | France . |
| 2006811 | 5/1979 | United Kingdom . |
| 95/31523 | 11/1995 | WIPO . |

OTHER PUBLICATIONS

A 1990 Rohm and Haas article entitled "Acusol™ Associative Thickener", no author listed, pp. 1–16. Month available.

A Sep. 9, 1968 excerpt from the Barcelona Proceedings of the International Congress on Surface Active Substances, pp. 965–974, Gulbeklan, et al., "Effect of surfactant on the viscosity of alkali–thickenable acrylate polymer emulsions".

International Search Report.

Association and Thermal Gelation in Mixtures of Hydrophobically Modified Polyelectrolytes and Nonionic Surfactants 1994 American Chemical Society date unavailable.

*Primary Examiner*—Jacqueline V. Howard

[57] ABSTRACT

Disclosed herein are surfactant complexes and methods for using them. The complexes contain nonionic surfactants in low concentrations. The surfactants are complexes with associative polymeric thickeners. These complexes can be formulated for use as laundry pre-spotters, hard surface cleaners, and insecticides. They can also be used in other applications.

16 Claims, No Drawings

SURFACTANT COMPLEX WITH ASSOCIATIVE POLYMERIC THICKENER

TECHNICAL FIELD

The present invention relates to water soluble surfactant complexes used for laundry pre-spotters and other applications. More particularly it relates to surfactant/associative polymeric thickener complexes where the surfactant is present in relatively low concentrations.

BACKGROUND ART

Laundry detergents are often deficient in handling stains due to grass, blood, oil, greases, and certain other sources. Consequently, various compositions have been developed as "pre-spotters" or "pre-washes". See e.g. U.S. Pat. Nos. 4,438,009; 4,595,527; and 4,749,516. The disclosure of these patents (and of all other publications described herein) are incorporated by reference as if fully set forth herein.

Such compositions are typically applied directly to difficult stains a few minutes before the normal washing process. However, those pre-spotters which are the most effective against stains can sometimes also lift the dye from cloth so as to create an undesirable faded area.

More generally, it is desirable to have effective hard surface cleaners that use relatively low levels of surfactants. Such cleaners are of interest as hand cleaners, window cleaners, and/or bathroom/kitchen cleaners. Surfactants having unusual characteristics are also desirable as carriers for insecticides and for various other applications (e.g. light benders).

There have been some attempts to combine polymeric thickeners with surfactants to improve cleaning characteristics. See e.g. U.S. Pat. Nos. 5,489,397; 5,393,454; and 5,393,453. However, none of these prior compositions has optimal characteristics, especially for use as a laundry pre-spotter.

In unrelated matters, there has been research regarding the gelation characteristics of highly diluted (e.g. 0.1% or much less) surfactants when mixed with various hydrophobically modified polyelectrolytes. See A. Sarrazin-Cartalas, et al. 10 Amer. Chem. Soc. 1421–1426 (1994).

DISCLOSURE OF INVENTION

In one aspect, the invention provides a nonionic surfactant complex having more than 0.2% and less than 5% by weight of a surfactant. There is also included from 0.01% to 10% by weight of an associative polymeric thickener that has more than two alkyl tails that each have between ten and twenty-four carbons in them, and at least 5% water. Preferably, there is at least 80% water. The surfactant preferably has an average HLB value of from 8.5 to 10.7.

A wide variety of nonionic surfactants are suitable, such as ethoxylated long chain (e.g. $C_6$–$C_{22}$) alcohols; propoxylated/ethoxylated long chain alcohols such as polytergents from Olin Corp. and Plurafac from BASF Corp.; ethoxylated nonylphenols, such as the Surfonic N Series available from Huntsman Corp.; ethoxylated octylphenols, including the Triton X Series available from Rohm & Haas; ethoxylated secondary alcohols, such as the Tergitol Series available from Union Carbide; and ethylene oxide propylene oxide block copolymers, such as the Pluronics available from B.A.S.F. Most preferably ethoxylated primary alcohols known as Neodols (available from Shell Chemical) are used. Best results have been achieved with $C_{12}/C_{13}$ Neodols, particularly those with 3.5–6 moles ethylene oxide (e.g. Neodol 23-4).

The complex should preferably include from about 3% to slightly under 5% nonionic surfactant. However, for window cleaner applications the concentrations may be closer to 0.5%. If desired, anionic, cationic, or amphoteric surfactants can also be added, but this is usually not preferred.

Associative thickeners are water-soluble or water swellable polymers that have chemically attached hydrophobic groups that are capable of non-specific hydrophobic associations. They are also known as hydrophobically modified water soluble polymers. Associative thickeners have traditionally been used in latex paint technology as rheological altering material. See, *Associative Thickeners,* (Handbook Coat. Addition) Schaller and Sperry, Dekker, New York, N.Y., (1992) Vol. 2, pp. 105–63. They have also been used in liquid soap compositions for altering the rheology of the compositions to alleviate post-use dripping problems of liquid hand soaps from soap dispensing units. More recently, they have been used with high levels of surfactants in certain cleaners.

The preferred associative thickeners utilized in the present invention are water soluble and impart pseudo plastic characteristics to laundry pre-spotter compositions after the polymer is neutralized to a pH of 5.5 or more. Such associative thickeners are generally supplied in the form of an acidic aqueous emulsion or dispersion.

Some associative thickeners of this type are addition polymers of three components: (1) an alpha-beta-monoethylenically unsaturated monocarboxylic acid or dicarboxylic acid of from 3 to 8 carbon atoms such as acrylic acid or methacrylic acid to provide water solubility, (2) a monoethylenically unsaturated copolymerizable monomer lacking surfactant capacity such as methyl acrylate or ethyl acrylate to obtain the desired polymer backbone and body characteristics, and (3) a monomer possessing surfactant capacity which provides the pseudo plastic properties to the polymer and is the reaction product of a monoethylenically unsaturated monomer with a nonionic surfactant compound wherein the monomer is copolymerizable with the foregoing monomers.

Additional associative polymer thickeners include maleic anhydride copolymers reacted with nonionic surfactants such as ethoxylated $C_{12}$–$C_{14}$ primary alcohol available under the trade name Surfonic L Series from Huntsman Corp. and Gantrez AN-119 from ISP.

Especially preferred thickeners are alkali-soluble acrylic emulsion polymers available under the trademark Acusol® from Rohm and Haas Co. Acusol 823 is a 30.0% active emulsion polymer composed of 44% methacrylic acid, 50% ethyl acrylate and 6% stearyl oxypoly ethyl methacrylate emulsion polymer having approximately 10 moles of ethylene oxide. See also the polymers generally described in U.S. Pat. No. 4,351,754. Acusol 820 is also suitable, as are Rheovis CR and CRX from Allied Colloids and ALCO EXP 2244 and 2245 from ALCO Chemical.

The associative thickener is preferably about 1–3% by weight (containing 0.3–0.9% active polymer solids) when the complex is be used as a laundry pre-spotter or hard surface cleaner.

Various conventional additives can be used with the complexes. Mildly alkaline pH (e.g. about 7–9%) can be achieved with NaOH (or KOH) buffered with borax. Citric acid can be added as a builder (as can other known builders and chelating agents). Standard enzymes, stain release agents, dispersing agents, solvents, preservatives, and fragrances can also be included such as Savinasa 16.0 EX (enzyme; Novo); Sokalan HP22 (an acetated polyvinyl alcohol stain release agent; BASF); Dowanol DPnB (a glycol ether solvent; Dow); Acusol 445N (a dispersing agent); and Kathon CG-ICP (a preservative; Rohm & Haas). Dyes, optical brighteners, corrosion inhibitors, defoamers, bactericides, bacteriostats, and the like can also be added. Extra additives of this type will normally total less than 15% by weight of a pre-spotter composition.

In another form, the associative polymeric thickener and surfactant are present in amounts such that upon removal of free water from the complex to form a dried film, less than 20% of the surfactant in the original complex is not bound thereby. This is when the water is removed by evaporation at ambient (50% relative humidity) conditions from a thin film. The free surfactant level in a dried film is determined gravimetrically by blotting the air dried film with #4 Whatman filter paper and determining the % of the film that is absorbed by the paper.

In yet another form, the associative polymeric thickener and surfactant are present in amounts such that upon removal of free water from the complex, greater than 8% of bound water from the original complex remains in film. This is when the composition is air dried at 50% relative humidity and ambient temperature from a thin film and the water content is measured using the Karl Fischer analytical method.

In another embodiment, the surfactant is of a low solubility type such that it would have a visible dispersed phase if present by itself at greater than 1% in a pure aqueous solution. Examples of such surfactants are the preferred Neodols.

In yet another aspect, the invention provides a method of laundering. One applies the above complexes to a stain on an article to be laundered and then launders the article after allowing contact for one minute or longer (e.g. over two hours) prior to laundering. In still another form, the invention can be used for cleaning glass.

The complexes of the present invention can be delivered by pouring, spraying, or discharge from a squeeze bottle.

The objects of the present invention therefore include providing surfactant complexes of the above kind:

(a) which contain relatively small amounts of surfactant, yet are still highly effective;

(b) which can be used as a laundry pre-spotter with little or no effect on the natural color of most common clothing items;

(c) which use only environmentally acceptable materials; and (d) which are also useful as an insecticide carrier and for other purposes.

These and still other objects and advantages of the present invention will be apparent from the description which follows. The following description is merely of the preferred embodiments. The claims should therefore be looked to in order to understand the full scope of the invention.

BEST MODES FOR CARRYING OUT THE INVENTION

The compositions of the present invention will now be illustrated by the following examples, wherein all percentages are by weight. Liquid compositions in the examples listed below were prepared by cold blending the following ingredients in the order specified below.

| Formula A | Formula B | Formula C | Material |
|---|---|---|---|
| 87.99 | 91.67 | 86.62 | Water |
| 0.5 | — | 0.53 | 5M Borax |
| 1.7 | 1.9 | 1.59 | 50% Citric Acid |
| 0.3 | 0.27 | 0.22 | 50% NaOH |
| 0.5 | — | 0.54 | Sokalan HP22 |
| 4.0 | 3.33 | 4.0* | Surfactant-Neodol 23-4 |
| 1.6 | — | 1.7 | Acusol-445N |
| 2.1 | 1.67 | 2.62 | Polymer-Acusol-823 |
| 0.1 | — | 0.12 | Fragrance |
| .78 | 1.16 | 0.9 | 50% NaOH |
| .03 | — | .04 | Kathon CG-ICP |
| 0.4 | — | 0.5 | Savinasa 16.0 EX109701 |
| — | — | 1.07 | Dowanol DPnB |

Mixture of Neodol 23-4 and Neodol 1-5

Alternative polymers were used as follows:

| Formula D | Formula E | Formula F | Material |
|---|---|---|---|
| 87.99 | 87.99 | 87.99 | Water |
| 0.5 | 0.5 | 0.5 | 5M Borax |
| 1.7 | 1.7 | 1.7 | 50% Citric Acid |
| 0.6 | 0.6 | 0.6 | 50% NaOH |
| 0.5 | 0.5 | 0.5 | Sokalan HP22 |
| 4.0 | 4.0 | 4.0 | Surfactant-Neodol 23-4 |
| 1.6 | 1.6 | 1.6 | Acusol-445N |
| 2.1 | 2.1 | 2.1 | Polymer |
| 0.1 | 0.1 | 0.1 | Fragrance |
| .48 | .48 | .48 | 50% NaOH |
| .03 | .03 | .03 | Kathon CG-ICP |
| 0.4 | 0.4 | 0.4 | Savinasa 16.0 EX 109701 |

For Formula D the polymer was Rheovis CR, for Formula E Alco EXP 2244, and for Formula F Alco EXP 2245. Other formulas substituted 2.1% Acusol 820 or Rheovis CRX.

To test the relative cleaning effectiveness of our formulas, we used the following test procedures.

The liquid pre-spotting compositions were applied to stains using 2 cc plastic droppers. The formulations were tested on 10 cm×10 cm cloth swatches of 65/35 polyester/cotton. Two drops of used motor oil were applied to each swatch. The oil was allowed to wick out overnight. The test swatches were washed the next day or placed into a freezer until needed. The swatches were saturated with 2 cc of the above formulations and allowed to sit for about five minutes.

Each stained fabric swatch was then machine washed using a Kitchen Aid Washer model AW560W. All test swatches were washed in the same machine wash load, using one level scoop of Ultra Tide Powder (0 phosphorus), at a 37° C. or 37.0° C. ten minute wash and 21° C. or 21.0° C. rinse. The water had about 130–150 ppm hardness from the Racine, Wis., city water supply. The swatches were dried in a standard clothes dryer for ten minutes on low heat, and were removed before the dryer shut off.

Reflectance measurements on stained cloth were made with a photoelectric colorimeter, the Hunter Lab, model #MS 4000L. Readings were made on a clean white Formica® countertop. All swatches were read in the same position/orientation. The measurements were made in day-light lighting conditions (no ultraviolet lighting). Three variables were collected $L_x$=reflectance, $a_x$=redness/greenness, and $b_x$=yellowness/blueness; where x is: c=clean swatch, d=dirty swatch, and w=washed swatch.

These three variables were entered in two equations which calculate the percentage of cleaning from the original stained swatch. The first equation determined the dirty index of the stained swatch (DI)(non treated), from the clean fabric before washing:

$$DI=[(L_c-L_d)^2+(a_c-a_d)^2+(b_c-b_d)^2)]^{0.5} \quad 1.$$

The second equation calculates the percentage of cleaning of the treated swatch from the stained swatch (PC or % Clean) after washing.

$$\%\ \text{Clean or}\ PC=100*[(L_w-L_d)^2+(a_w-a_d)^2+(b_w-b_d)^2)]^{0.5}/DI \quad 2.$$

Formulas A–C (and other formulations within the claim scope) exhibited superior cleaning effectiveness. Various of the tested formulations were also evaluated for color extraction. For example, Formula A showed an 83.82 cleaning effectiveness with no visible color extraction.

Table A below depicts the effects of varying surfactant levels in formulas roughly based on Formula C. The staining material tested here was a mix of grease and particulate material.

TABLE A

| Surfactant % | Cleaning |
|---|---|
| 0 | 62.4 |
| 1 | 70.7 |
| 2 | 72.6 |
| 3 | 73.4 |
| 4 | 74.0 |
| 5 | 73.3 |
| 6 | 72.5 |

Surprisingly, cleaning peaked in the 2–5% range.

We have a number of possible theories why the prespotters of the present invention work without adversely affecting color, even when there is a prolonged contact (e.g. days). In this regard we believe that the polymer binds the surfactant, at least some of it, with a large amount of bound water. The water is believed to stop the migration of dye off the fabric, i.e. high water, low dye transfer.

Also, we use very low surfactant levels. High surfactant levels are known to contribute to color removal.

Moreover, we believe that free surfactant that is a liquid in the neat, dry state is also a solvent. The solvent action of liquid surfactants causes the dye to be extracted into the surfactant and removed during washing. However, surfactant that is bound in a polymer matrix is not free to act as a solvent, i.e. the product dries to a solid or waxy film, stopping the solvent action. In sum, three different effects appear to be contributing to the attribute of resistance to color removal.

While a variety of insecticidally active complexes could be created using the present invention, one example is:

94.22% by weight water 0.75% by Borax 1.5% by weight Acusol 823

2% by weight Neodol 23-4

0.5% by weight insecticidally active agent.

1% Acusol 445N 0.03% Kathon CG-ICP

Examples of insecticidally active agents are pyrethrurn, chlorpyriphos, propoxur, pernethrin, resmethrin, bioallethrin, allethrin, other pyrethroids and mixtures thereof Other insect control agents are the repellents citronella, lemon grass oil, lavender oil, cinnamon oil, neem oil, clove oil, sandlewood oil, and geraniol, and the insect growth regulator hydroprene.

A sample of the above formula, in which the agent was chlorpyriphos, was an effective insecticide.

Hand Cleaner

A small amount of Formula A was used as a replacement for a conventional liquid hand soap. Good cleaning results (and some hand softening) was noted.

Light Bender 1 ml of Formula A was deposited on a glass slide and allowed to dry by evaporation. When the desired slide was inserted in a crossed polarized light beam tester, distinct birefringence (light bending) was noted.

Birefringence is a phenomenon that is evidence of the existance of regions of lamellar phase within aqueous, liquid formulations including the surfactant complex of the invention. We believe, as a theory only, that the existance of this structure contributes to the effective solubilizing of a variety of hydrophobic and hydrophylic staining substances. Therefore one alternative way of characterizing a prespotter within the scope of the invention is that (1) it includes a surfactant complex in accordance with the disclosure, above, including, for example, more than 0.2% and less than 5% by weight of a nonionic surfactant; from 0.01% to 10% by weight of an associative polymeric thickener that has more than two alkyl tails that have between ten and twenty-four carbons in them; and at least 5% by weight water, and that (2) it also exhibit evidence of lamellar phase structure.

Various techniques are well established in the art as reliable means to demonstrate the existance of lamellar phase structure in a liquid. By way of example only, the optical characteristics of gross samples may be observed together with the time dependant behavior of the sample, as described by Jonströmer and Strey, R. in *J. Phys. Chem.,* 1992 Volume 96, Pages 5993–6000. Samples also may be examined by light microscope, using Nomarski optics microscopy. Freeze-fracture electron microscopy also may be used (see van de Pas, et al. *Colloid Surf A,* 1994, 85, 221–236); as may cryo transmission electron microscopy (see Bellare, J. R., et al. *J Electron Microsc. Tech.,* 1988, 10, 87–111) or small-angle X-ray or neutron scattering (see *Small Angle X-Ray Scattering;* Glatter, O. and Kratky, O. eds.: Academic: New York, 1982.) These techniques have varying degrees of sensitivity and respond differently to variations in the lamellar phase structure present, yielding possible false negatives. Therefore detection of lamellar phase by any one of such means governs, even in the face of a failure of another detection means.

While the above surfactants complexes are preferred, a variety of other complexes are also intended. Thus, the claims below should be looked to in order to understand the fill scope of the present invention.

Industrial Applicability

This invention provides cleaners such as hard surface cleaners and laundry pre-spotters. It also has utility as a insecticide carrier, and likely will have utility as a polarized light bender.

We claim:

1. A laundry prespotter surfactant complex, comprising:

at least 2% and less than 5%, by weight, of a nonionic surfactant having an average HLB value of between 8.5 and 10.7;

from 0.01% to 10% by weight of an associative polymeric thickener that has more than two alkyl tails that have between ten and twenty-four carbons in them; and at least 5% by weight water.

2. The surfactant complex of claim 1, wherein there is at least 50% by weight water.

3. The surfactant complex of claim 1, wherein there is at least 80% by weight water.

4. The surfactant complex of claim 1, wherein the surfactant would have a visible dispersed phase if present by itself at greater than 1% in a pure aqueous solution.

5. The surfactant complex of claim 1, wherein the nonionic surfactant is selected from the group consisting of ethoxylated alcohols.

6. The surfactant complex of claim 1, wherein the associative polymeric thickener an emulsion polymer of methacrylic acid, ethyl acrylate and stearyl oxypoly ethyl methacrylate emulsion polymer with ethylene oxide.

7. The surfactant complex of claim 1, further comprising borax, citric acid, and sodium hydroxide.

8. The surfactant complex of claim 1, wherein the complex is a cleaner.

9. The surfactant complex of claim 1, wherein the complex exhibits birefringence.

10. The surfactant complex of claim 1 in liquid form, wherein lamellar phase structure can be detected within the liquid.

11. The surfactant complex of claim 1, wherein the associative polymeric thickener and surfactants are present in amounts such that, upon removal of free water from the complex to form a dried film, less than 20% of said surfactant in the complex is not bound thereby.

12. The surfactant complex of claim 1, wherein the associative polymeric thickener and the surfactant are present in amounts such that, upon removal of free water from the complex to form a dried film, greater than 8% of the water remains as bound water in the dried film.

13. A laundry prespotter surfactant complex, comprising:

at least 2% and less than 5% by weight of a nonionic surfactant, wherein the surfactant is a surfactant having an average HLB value between 8.5 and 10.7 that would have a visible dispersed phase if present by itself at greater than 1% in a pure aqueous solution;

from 0.01% to 10% by weight of an associative polymeric thickener that has more than two alkyl tails that have between ten and twenty-four carbons in them; and at least 5% by weight water.

14. A method of laundering, comprising the steps of:

a. applying an effective amount of the claim 1 complex to a stain on an article to be laundered; and b. laundering the article.

15. A method of cleaning a stain from the surface of an article, comprising the steps of;

a. apply an effective amount of the claim 1 complex to a stain on the article surface;

b. thereafter waiting at least two hours before laundering the article; and c. then laundering the article.

16. The method of claim 15, wherein the article is selected from the group consisting of fabric and carpeting.

* * * * *